United States Patent [19]

Seigh

[11] 4,262,874

[45] Apr. 21, 1981

[54] PLATE HANGER

[76] Inventor: William Seigh, 25065 Castlereigh, Farmington Hills, Mich. 48018

[21] Appl. No.: 21,582

[22] Filed: Mar. 19, 1979

[51] Int. Cl.[3] ..... A47F 7/14

[52] U.S. Cl. ..... 248/467; 248/496

[58] Field of Search ..... 248/467, 477, 495, 496

[56] References Cited

U.S. PATENT DOCUMENTS

| | | | |
|---|---|---|---|
| 999,961 | 8/1911 | Colas | 248/496 X |
| 1,600,919 | 9/1926 | Baalsrud et al. | 248/496 |
| 2,483,114 | 9/1949 | Van Schoor et al. | 248/496 |
| 3,218,747 | 11/1965 | Cornfield | 248/496 X |
| 3,884,443 | 5/1975 | McMaster | 248/467 |

*Primary Examiner*—William H. Schultz

*Attorney, Agent, or Firm*—Fisher, Gerhardt, Crampton & Groh

[57] ABSTRACT

A hanger for supporting a plate on a vertical wall wherein the hanger has an arcuate transparent body portion which is bonded with transparent adhesive to the back of the plate. The hanger is provided with a plurality of adjacent notches permitting orientation of the plate relative to a wall mounted hanger element and is transparent to permit reading of notations on the back of a plate.

4 Claims, 5 Drawing Figures

PLATE HANGER

This invention relates to article hangers and more particularly to plate hangers for supporting plates on vertical walls for display.

Collectors of plates often desire to hang their collections for display on vertical walls. Prior art structures which are available are in a form of bracket or rack structures which are detachably attached to the plates, such arrangements are visible and detract from the plate. Also, such hangers prevent the plate from being disposed in close proximity to the wall and also obscures any identification that might be located on the back of a plate. With such devices the hanger must be oriented carefully relative to the plate before the plate is mounted on a wall. Many plates have ornamental or pictorial designs which require careful orientation in order to be appreciated visually. Consequently, plate hangers which permit adjustable positioning are highly desirable.

It is an object of the invention to provide a plate hanger which is attached to a plate and affords a variety of hanging positions properly orienting the plate for view.

Another object of the invention is to provide a plate hanger which permits a plate to be mounted on a wall in substantially flat contacting relationship with the wall.

Still another object of the invention is to provide a plate hanger which may be attached to plate in such a manner that it minimizes obstruction to reading identification and other indicia on the back of the plate.

These and other objects of the invention will become apparent from the following description and from the drawings in which.

Figure 1:
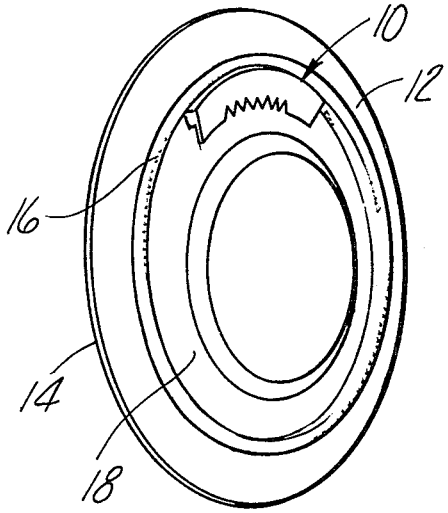
FIG. 1 is a prospective view of a back of a plate with a plate hanger embodying the invention in position.
Figure 2:
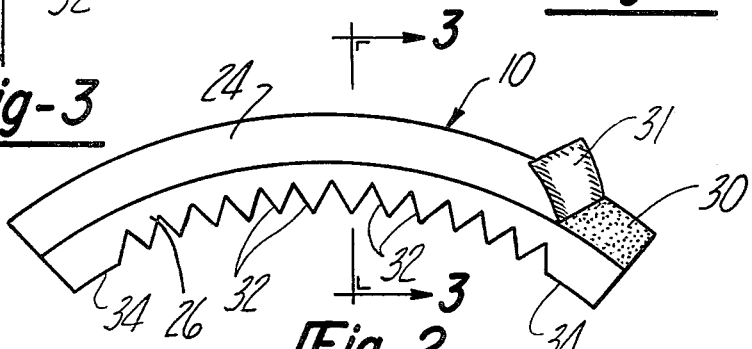
FIG. 2 is an elevational view of a plate hanger prior to its attachment to a plate.

Referring to the drawings and particularly to FIG. 1, a plate hanger embodying the invention is designated generally at 10 and is shown mounted on the bottom of a plate 12 having an outer circumferential rim 14 and an inner circumferential rim 16. The inner rim 16 forms a ridge or bead which supports the plate when it is disposed on a horizontal surface such as a table so that the bottom portion 18 of the plate 12 is slightly elevated above the table surface. The bottom 18 and the lip 16 define a shallow cavity 20 at the under side or back surface of the plate.

Figure 3:
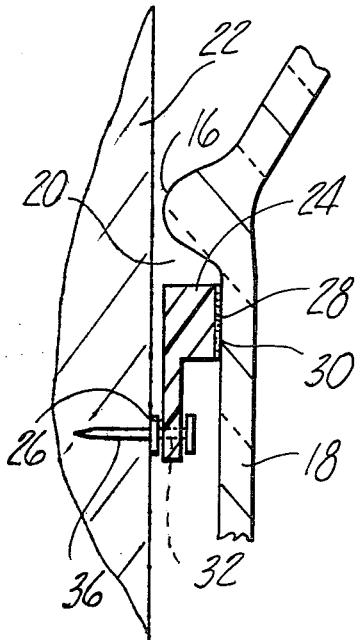
FIG. 3 is a cross sectional view of the plate hanger taken on line 3—3 in FIG. 2 and showing associated portions of a plate to which the hanger is attached and a wall on which the plate is displayed.

The hanger 10 which is used to support the plate 12 relative to a vertical wall such as that illustrated in FIG. 3 at 22, is a segment of an annular member and includes a body portion 24 having an arcuate flange 26. The body portion 24 has a flat surface 28 and the arcuate flange 26 is axially spaced from the flat surface 28. Flat surface 28 is provided with a layer of adhesive 30 which is utilized to bond the hanger 10 to the bottom wall 18 of a plate.

The hanger 10 is made of transparent plastic material which will not obstruct visibility. Similarly the adhesvie layer 30 can be any form of acrylic or transparent adhesvie which will bond the hanger 10 to the rear of a plate. In actual practice it has been found that a double backed tape also can be used. One such tape is manufactured by Minnesota Mining and Manufacturing Company and is identified as an adhesive transparent transfer tape, No. 950. One adhesive surface of such tape can be made to adhere to the flat surface 28 of the hanger 10 and the other of the adhesive surfaces is available for attachment to the bottom surface 18 of a plate. Whether tape or a layer of other adhesive, the surface can be temporarily covered by a disposable, protective strip 31 which can be peeled from the adhesive layer when the hanger is ready to mount on the plate 12.

The hanger 10 is intended to be secured to the bottom 18 of the plate 12 by way of the layer of adhesive 30 so that the arcuate hanger 10 is oriented close to the inner rim 16 and substantially concentricly with the plate. When attached to the plate 12, the flange 26 is spaced from the plate bottom 18 and the radially inner circumferential portion of the arcuate flange is provided with a plurality of notches 32 which are disposed in adjacent relationship to each other. The notches 32 are spaced from opposite ends of the body portion 24 by portions 34.

Referring now to FIG. 3, it is preferred that the hanger 10 have a thickness approximating the depth of the cavity 20 and also that the hanger 10 be mounted closely to the inner rim 16.

To support a plate relative to a wall 22, a hanger element 36, which in the present instance is a double headed nail, is first positioned at a desired location in the wall. Thereafter a plate with a hanger 20 may be placed with one of the notches 32 in engagement with the shank of the nail 36. If the plate 12 is not properly oriented to a viewer, a different notch can be selected by rotating the plate in one direction or the other about its axis until the desired notch is aligned with the nail shank. The end portions 34 of the flange 26 serve as stops since during adjustment of a plate, the lack of notches can be sensed and acts as a warning that the plate is not properly seated with a notch 32 on the hanger element on nail 36.

Since the hanger 10 including the adhesive layer 30 is transparent, it can be located without exercising excessive care and without fear of obstructing notations or other indicia appearing on the back of the plate.

Figure 4:
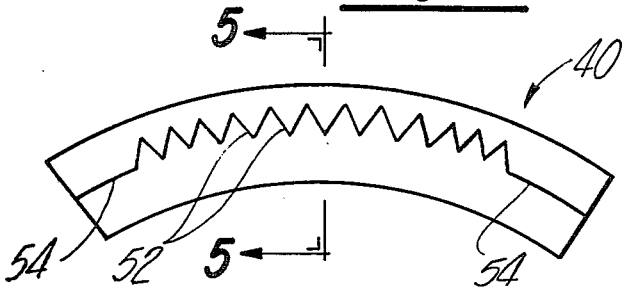
FIG. 4 is a view similar to FIG. 2 of another embodiment of the invention.
Figure 5:
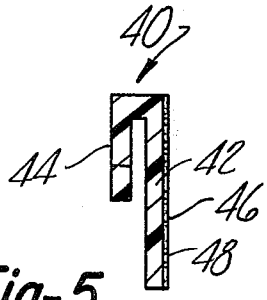
FIG. 5 is a cross sectional view taken on line 5—5 in FIG. 4.

Referring now to FIGS. 4 and 5, another embodiment of the invention is seen in which a hanger 40 has a generally channel shape cross section with oppose parallel legs 42 and 44. The leg 42 forms a flat surface 46 to support a layer of transparent adhesive 48 which is similar to the layer of adhesive 30. The leg 44 forms an arcuate flange in which a plurality of adjacent notches 52 are formed corresponding to the notches 32 in hanger 10. Also, the flange 44 has portions 54 at opposite ends of the notches similar to the portions in hanger 10 which define the limits of adjustment of the plate 12. In this embodiment of the invention the hanger 40 is mounted in the same manner and in the same location as the hanger 10. The flat surface 46 and consequently the area of the adhesive 48 can be substantially larger than with the prior embodiment and can be used on plates of greater weight and size where a greater adhesive bearing surface may be desired.

The hanger 40 like the hanger 10 is made of transparent plastic material and the adhesive layer 30 also is formed of a similarly transparent non-coloring adhesive.

A hanger has been provided for hanging displayed plates on a vertical wall in which the hanger is transparent and is bonded to the back of a plate at a location permitting the plate to be supported in closely adjacent relation to a vertical wall. Also the plate can be adjusted to different selected positions by rotating the plate slightly about its axis. This permits the hanger to be attached to the plate without exercising great care as to exact location of the hanger and also permits notations or initia on the back of the plate which otherwise would be obscured by the hanger to be observed through the transparent hanger and adhesive.

I claim:

1. A hanger assembly for hanging a plate on a wall comprising; a body portion in the form of an arc of an annulus, said body portion including a first arcuate flange, a second arcuate flange spaced from said first arcuate flange, said second flange having a radial width greater than said first flange and forming a flat surface, a layer of adhesive disposed on said flat surface and being adapted to bond said body portion to the bottom surface of a plate adjacent to the bottom rim of said plate, said first flange having uniformly spaced adjacent notches formed in an inner circumferential portion of said arcuate flange and in axially spaced relationship to said layer of adhesive, a hanger element adapted to be supported on a wall to receive a selected one of said notches, said hanger element having a head portion disposed in the space between said first flange and layer of adhesive.

2. The combination of claim 1 wherein said body is made of transparent material.

3. The combination of claim 1, wherein said adhesive is pressure sensitive and is transparent.

4. The combination of claim 1, wherein said flanges form a space therebetween to receive said head portion of said hanger element.

* * * * *

UNITED STATES PATENT AND TRADEMARK OFFICE

CERTIFICATE OF CORRECTION

PATENT NO. : 4,262,874

DATED : April 21, 1981

INVENTOR(S) : William Seigh

It is certified that error appears in the above—identified patent and that said Letters Patent is hereby corrected as shown below:

Column 2, line 36, "hanger 20" should read --hanger 10--

Signed and Sealed this

*Ninth* Day of *March 1982*

[SEAL]

*Attest:*

GERALD J. MOSSINGHOFF

*Attesting Officer*

*Commissioner of Patents and Trademarks*